US006969288B2

(12) United States Patent
Matsuda

(10) Patent No.: US 6,969,288 B2
(45) Date of Patent: Nov. 29, 2005

(54) WATER-JET PROPULSION PERSONAL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/811,123

(22) Filed: Mar. 25, 2004

(65) Prior Publication Data

US 2004/0209533 A1 Oct. 21, 2004

(30) Foreign Application Priority Data

Mar. 28, 2003 (JP) ..... 2003-090106

(51) Int. Cl.[7] ..... B63H 20/14
(52) U.S. Cl. ..... 440/75; 440/111
(58) Field of Search ..... 440/75, 111

(56) References Cited

U.S. PATENT DOCUMENTS 4,382,797 A * 5/1983 Blanchard ..... 440/53
5,511,505 A * 4/1996 Kobayashi et al. ..... 114/55.5
5,846,102 A * 12/1998 Nitta et al. ..... 440/1
6,132,268 A * 10/2000 Uchino et al. ..... 440/38
6,135,832 A * 10/2000 Suzuki ..... 440/83

FOREIGN PATENT DOCUMENTS

JP 11-208582 8/1999

* cited by examiner

*Primary Examiner*—Sherman Basinger
(74) *Attorney, Agent, or Firm*—Alleman Hall McCoy Russell & Tuttle LLP

(57) ABSTRACT

A water-jet propulsion personal watercraft is disclosed. The personal watercraft typically includes a body including a hull and a deck covering the deck from above, a water jet pump configured to propel the watercraft and including a pump shaft extending in a longitudinal direction of the body, a V-type four-cycle engine mounted within the body and configured to drive the water jet pump, wherein the engine includes a crankshaft, an output shaft extending in a direction substantially perpendicular to the crankshaft and connected to the pump shaft, the output shaft being configured to output rotation transmitted from the crankshaft to outside the engine, and a rotation transmission system configured to transmit the rotation of the crankshaft to the output shaft, wherein the engine is mounted within the body in such a manner that the crankshaft extends in a width direction of the body.

16 Claims, 6 Drawing Sheets

WATER-JET PROPULSION PERSONAL WATERCRAFT

BACKGROUND OF THE INVENTION

1. Field of the Invention

The present invention relates to a water-jet propulsion personal watercraft (PWC). More particularly, the present invention relates to a personal watercraft in which a V-type four-cycle engine is mounted.

2. Description of the Related Art

In recent years, jet-propulsion personal watercraft have been widely used in leisure, sport, rescue activities, and the like. The jet-propulsion personal watercraft include a straddle-type personal watercraft equipped with a seat mounted over an upper portion of a body and straddled by an operator, and a stand-up type personal watercraft provided with a foot deck formed on a rear portion of the body on which an operator rides in a standing position. The stand-up type personal watercraft is relatively small. The straddle-type personal watercraft can accommodate three or more, or two or fewer persons.

In both the stand-up type personal watercraft and the straddle-type personal watercraft, the body typically includes a hull and a deck covering the deck from above, and a deck opening is formed on an upper surface of the deck so that an engine and auxiliary devices may be mounted into the body therefrom. The engine is mounted within a space surrounded by a hull and a deck and located below the deck opening. A water jet pump is equipped on a rear portion of the body. Driven by the engine, the water jet pump pressurizes and accelerates water sucked from a water intake generally provided on a bottom surface of the hull and ejects it rearward from an outlet port of the water jet pump. As the resulting reaction, the personal watercraft is propelled forward.

The engine may be generally categorized as an in-line engine, or a V-type engine, etc., according to the arrangement of cylinders, and may be categorized as a two-cycle engine, or a four-cycle engine, etc., according to combustion stroke. The engine is mounted within the body in such a manner that a crankshaft extends in parallel with a pump shaft of the water jet pump, i.e., in a longitudinal direction of the body, or the crankshaft extends in a width direction of the body, i.e., in a lateral direction of the body.

Recently, in some personal watercraft, a four-cycle in-line engine having a crankshaft extending in the longitudinal direction has been put into practical use instead of the conventional two-cycle in-line engine, as the engine configured to drive the water jet pump of the personal watercraft. In other personal watercraft, a four-cycle in-line engine has a crankshaft extending in the lateral direction, or a V-type engine has a crankshaft extending in the longitudinal direction (see Japanese Laid-Open Patent Application Publication No. 11-208582, and U.S. Pat. No. 5,853,308). In the V-type engine having the crankshaft extending in the longitudinal direction of the body, adjacent cylinders are arranged in V-shape as seen in a rear view.

Since the engine is generally a heavy component in the personal watercraft, its center of gravity affects the attitude of watercraft. It is therefore desirable to locate the center of gravity of the engine mounted in the watercraft as low as possible. Nonetheless, since the conventional four-cycle in-line engine is constructed such that the cylinders extend substantially vertically, and a cam, a camshaft, air-intake and exhaust valves, which are relatively heavy, are located above the cylinders, the center of gravity tends to be high regardless of the placement of the crankshaft.

On the other hand, since the V-type four-cycle engine has inclined cylinders, its center of gravity is located relatively low in contrast to the in-line engine having the cylinders extending substantially vertically. The V-type four-cycle engine can be designed to reduce a dimension in an axial direction of the crankshaft. In addition, the V-type four-cycle engine can smoothly rotate by inhibiting its vibration caused by reciprocation of pistons.

In the case of the stand-up type personal watercraft, the body has a relatively small width and a narrow internal space. In addition, for the purpose of rigidity of the body, a deck opening is designed to have a limited opening area, and hence a small dimension in the width direction. On the other hand, the V-type four-cycle engine has a relatively large dimension in the direction perpendicular to the crankshaft, i.e., a dimension of the engine in the width direction of the body with the crankshaft extending in the longitudinal direction. Therefore, it is difficult to mount the V-type four-cycle engine into the body through the deck opening.

If such a V-type engine is mounted within the body such that the crankshaft extends in the longitudinal direction, cylinder heads located above the cylinders arranged in a V-shape extend partially outside the deck opening within the body. In this structure, a valve drive system contained within the cylinder heads is difficult to maintain through the deck opening. In some V-type engines, auxiliary devices such as an exhaust manifold and an oil tank are arranged below the inclined cylinders (i.e., in the vicinity of the bottom of the body). If this V-type engine is mounted within the body such that the crankshaft extends in the longitudinal direction, the auxiliary devices located in the vicinity of the bottom portion of the body is difficult to maintain through the deck opening, because a space between the engine and an inner wall of the body is small.

SUMMARY OF THE INVENTION

The present invention addresses the above-described condition, and an object of the present invention is to provide a water-jet propulsion personal watercraft which is equipped with a V-type four-cycle engine with a center of gravity located relatively low.

According to the present invention, there is provided a water-jet propulsion personal watercraft, comprising a body including a hull and a deck covering the deck from above; a water jet pump configured to propel the watercraft and including a pump shaft extending in a longitudinal direction of the body; and a V-type four-cycle engine mounted within the body and configured to drive the Water jet pump, the engine having a front-side cylinder inclined to extend upward and forward, and a rear-side cylinder inclined to extend upward and rearward, wherein the engine includes a crankshaft, an output shaft extending in a direction substantially perpendicular to the crankshaft and connected to the pump shaft, the output shaft being configured to output rotation transmitted from the crankshaft to the outside of the engine; and a rotation transmission system configured to transmit the rotation of the crankshaft to the output shaft, wherein the engine is mounted within the body in such a manner that the crankshaft extends in a width direction of the body.

The dimension in the direction perpendicular to the crankshaft is larger, but the dimension in the axial direction of the crankshaft is smaller in the V-type four-cycle engine than the in-line four-cycle engine having equal cylinders in number.

So, in order to mount the V-type four-cycle engine within a limited space of the watercraft, the crankshaft is placed so as to extend in the width direction of the body. In the above construction, a rotational force generated by the V-type engine having the crankshaft extending in the width direction can be transmitted to the pump shaft through the rotation transmission system to drive the water jet pump.

As described above, since the dimension of the V-type engine in the axial direction of the crankshaft, i.e., dimension of the V-type engine in the width direction of the watercraft, is relatively small, the V-type engine can be easily contained within a limited space in the body.

The rotation transmission system may have a drive gear mounted concentrically on the crankshaft and configured to rotate integrally with the crankshaft, and a rotation axis change system configured to transmit the rotation of the crankshaft to the output shaft in such a manner that a rotation axis of rotation of the drive gear is different from a rotation axis of rotation of the output shaft. In this structure, the rotation of the crankshaft can be transmitted to the output shaft extending in the direction substantially perpendicular to the crankshaft through the drive gear and the rotation axis change system.

The rotation transmission system may have an intermediate shaft provided in parallel with the crankshaft, an intermediate gear mounted concentrically on the intermediate shaft and configured to rotate integrally with the intermediate shaft in mesh with the drive gear, an output-side bevel gear mounted concentrically on the intermediate shaft and configured to rotate integrally with the intermediate shaft, and an input-side bevel gear mounted on the output shaft and configured to mesh with the output-side bevel gear.

In the above construction, even when the engine is mounted within the body such that the crankshaft extends in the width direction, the rotation transmission system configured to transmit the rotation of the crankshaft to the pump shaft has a simple and compact construction.

The drive gear may be formed on an outer peripheral portion of a crank web of the crankshaft. In this structure, the number of parts can be reduced and, since the crankshaft can be shorter and the engine can be small in size, the V-type engine is easier to mount in a limited space of the watercraft.

The engine may include an oil pump having a pump shaft connected integrally with the intermediate shaft. Thereby, the number of parts can be reduced and a small-sized engine is achieved. Further, components in the vicinity of the oil pump can be maintained easily.

The rotation transmission system may be configured to transmit the rotation of the crankshaft to the output shaft in such a manner that a rotation speed of the output shaft is different from a rotation speed of the crankshaft. In this structure, the rotation transmission system increases or decreases the rotation speed of the output shaft when transmitting the rotation of the crankshaft to the output shaft. Thereby, the rotation speed compatible with a characteristic of the water jet pump is gained by the output shaft.

The output shaft may be provided such that its axial direction corresponds with the longitudinal direction of the body, and may be rotatably supported by a rear wall of a crank chamber formed within a crankcase of the engine to accommodate the crankshaft therein. In this structure, the output shaft extending rearward can be easily attached to the crankcase.

The crankshaft may be supported by bearings mounted on right and left side walls of the crank chamber of the crankcase, and a bearing mounted on a center wall provided within the crank chamber, and the output shaft may be supported in the vicinity of a connecting portion between the center wall and the rear wall. In this structure, the output shaft can be rigidly supported by the crankcase.

The rear-side cylinder of the engine may be placed such that an inclination angle of the rear-side cylinder with respect to a vertical plane including a center axis of the crankshaft is smaller than that of the front-side cylinder with respect to the vertical plane, and the rotation transmission system may be disposed behind the crankshaft and under the rear-side cylinder. Such a structure provides a space behind the crankshaft and under the rear side cylinder in which the rotation transmission system can be disposed.

The engine may have a camshaft drive gear mounted on one end portion of the crankshaft to drive a camshaft driven gear mounted on one end of a camshaft located above each of the cylinders and a generator mounted on an opposite end portion of the crankshaft. Since the camshaft drive gear and the generator, which are relatively heavy, are located at both ends of the crankshaft, weights in the axial direction of the crankshaft, i.e., in the width direction of the body are well balanced.

The engine may have a relay gear provided between the camshaft drive gear and the camshaft driven gear, and the relay gear may have a first relay gear, and a second relay gear located closer to a center of the engine than the first relay gear in a longitudinal direction of the crankshaft and configured to rotate integrally with the first relay gear, wherein the first relay gear meshes with the camshaft drive gear and the second relay gear is connected to the camshaft driven gear through a chain or a belt.

In this construction, the second relay gear connected to the driven gear of the camshaft is offset toward the center of the engine relative to the camshaft drive gear mounted on the end portion of the crankshaft. Thereby, the length of the camshaft can be reduced, and hence the cylinder head can be small in size.

The water-jet-propulsion personal watercraft may further comprise an exhaust system passage extending from a cylinder head of the engine, and an air cleaner box provided in an air-intake system of the engine, wherein the exhaust system passage is provided on one end side of the crankshaft and the air cleaner box is provided on an opposite end side of the crankshaft. Since the exhaust system passage and the air cleaner box which are relatively heavy are positioned on both sides of the crankshaft, weights in right and left parts of the engine are well balanced.

The engine may have an air-intake chamber provided in a bank space between the front-side cylinder and the rear-side cylinder such that the air-intake chamber is located downstream of the air cleaner box in the intake airflow and connected to air-intake ports of the engine through air-intake pipes. In this structure, since the bank space is efficiently utilized to dispose the air-intake box. Therefore, the engine can be easily mounted within the limited space of the watercraft.

The air-intake pipes may be respectively provided with injectors extending substantially vertically downward. In this structure, fuel injected from the injector is quickly delivered into a combustion chamber together with taken-in air. This is favorable to operation of the engine.

The body may have a deck opening elongate in the longitudinal direction of the body on an upper portion of the body, and a portion located above each of the cylinders of the engine may be located within the deck opening as seen in a plan view. In this structure, the engine is easily mounted into the body and detached therefrom through the deck opening. Further, components of the engine mounted within the body, for example, valve system components within the cylinder head, can be maintained easily through the deck opening.

The above and further objects and features of the invention will more fully be apparent from the following detailed description with accompanying drawings.

DETAILED DESCRIPTION OF THE PREFERRED EMBODIMENTS

Hereinafter, a personal watercraft equipped with a V-type four-cycle engine of an embodiment of the present invention will be described with reference to the accompanying drawings. The direction used hereinbelow corresponds with the direction in which the watercraft travels, from the perspective of the operator riding on the watercraft and facing a forward side of the watercraft.

Figure 1:
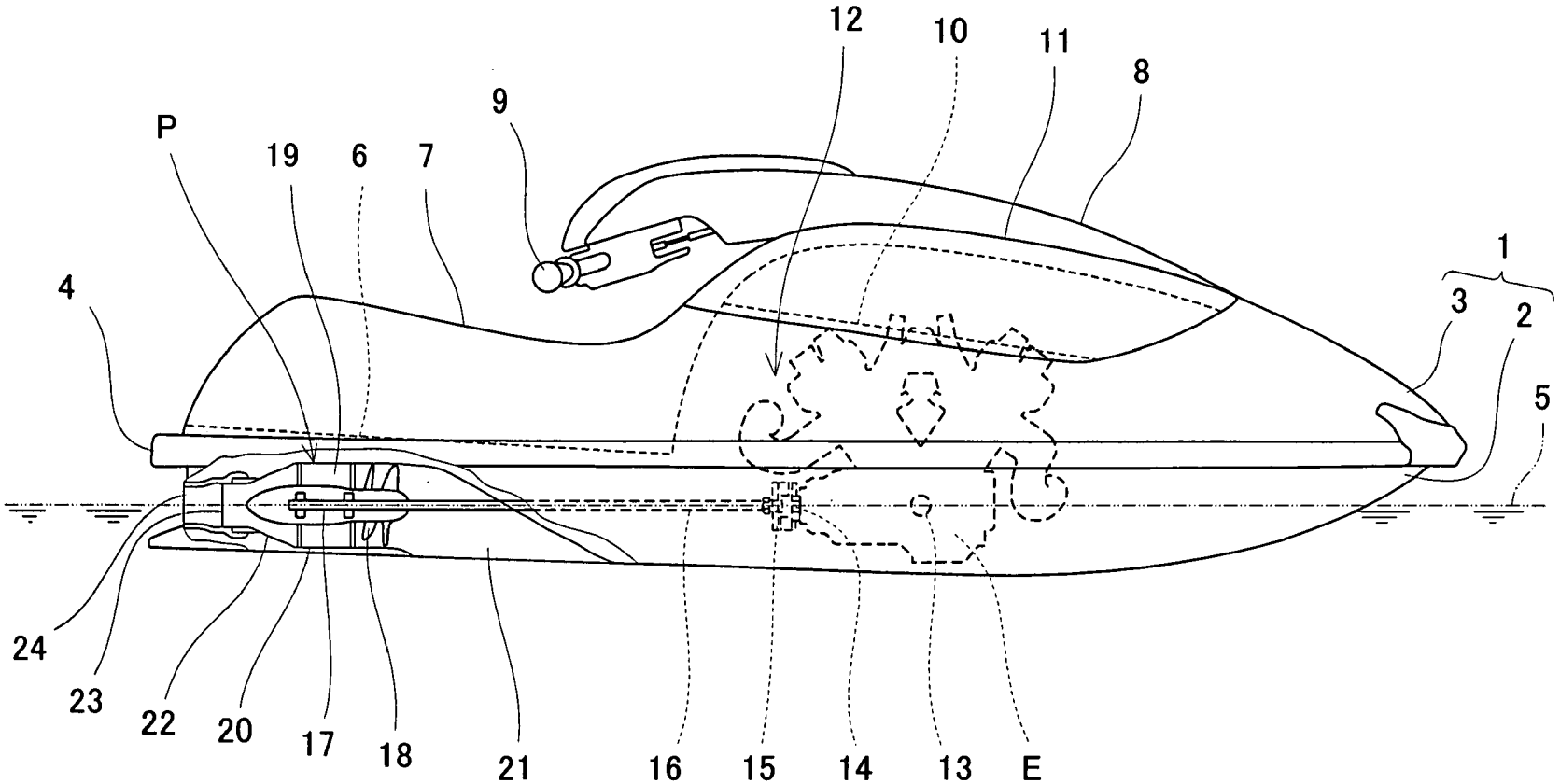
FIG. 1 is a side view of a personal watercraft according to an embodiment of the present invention.

FIG. 1 is a side view of a personal watercraft according to an embodiment. The personal watercraft is a stand-up type personal watercraft. A body 1 of the watercraft comprises a hull 2 and a deck 3 covering the hull 2 from above. A line at which the hull 2 and the deck 3 are connected over the entire perimeter thereof is called a gunnel line 4. In the personal watercraft according to this embodiment, reference numeral 5 denotes a waterline under the state in which the personal watercraft is at rest on water.

The deck 3 has a flat foot deck 6 extending from a vicinity of the center in the longitudinal direction of the body 1 to a rear end thereof. Deck fins 7 are respectively provided on right and left ends of the foot deck 6 so as to protrude upward from an upper surface of the foot deck 6. An elongate steering column 8 has a front end portion pivotally supported on a front portion of the deck 3 and extends rearward. A steering handle 9 is attached to a rear end portion of the steering column 8. The operator rides on the watercraft in a standing or kneeling position on the foot deck 6 and steers the steering handle 9 to operate the watercraft.

The deck 3 has a deck opening 10 extending forward from the vicinity of the center in the longitudinal direction of the body 1 to allow inside and outside of the body 1 to communicate with each other. The deck opening 10 is elongate in the longitudinal direction of the body 1 and rectangular. A deck hood (engine hood) 11 is removably attached over the deck opening 10 to open and close the deck opening 10. An engine room 12 is formed inside of the body 1 to be located forward of the foot deck 6 and below the deck opening 10. A V-type engine E is mounted within the engine room 12.

Figure 3:
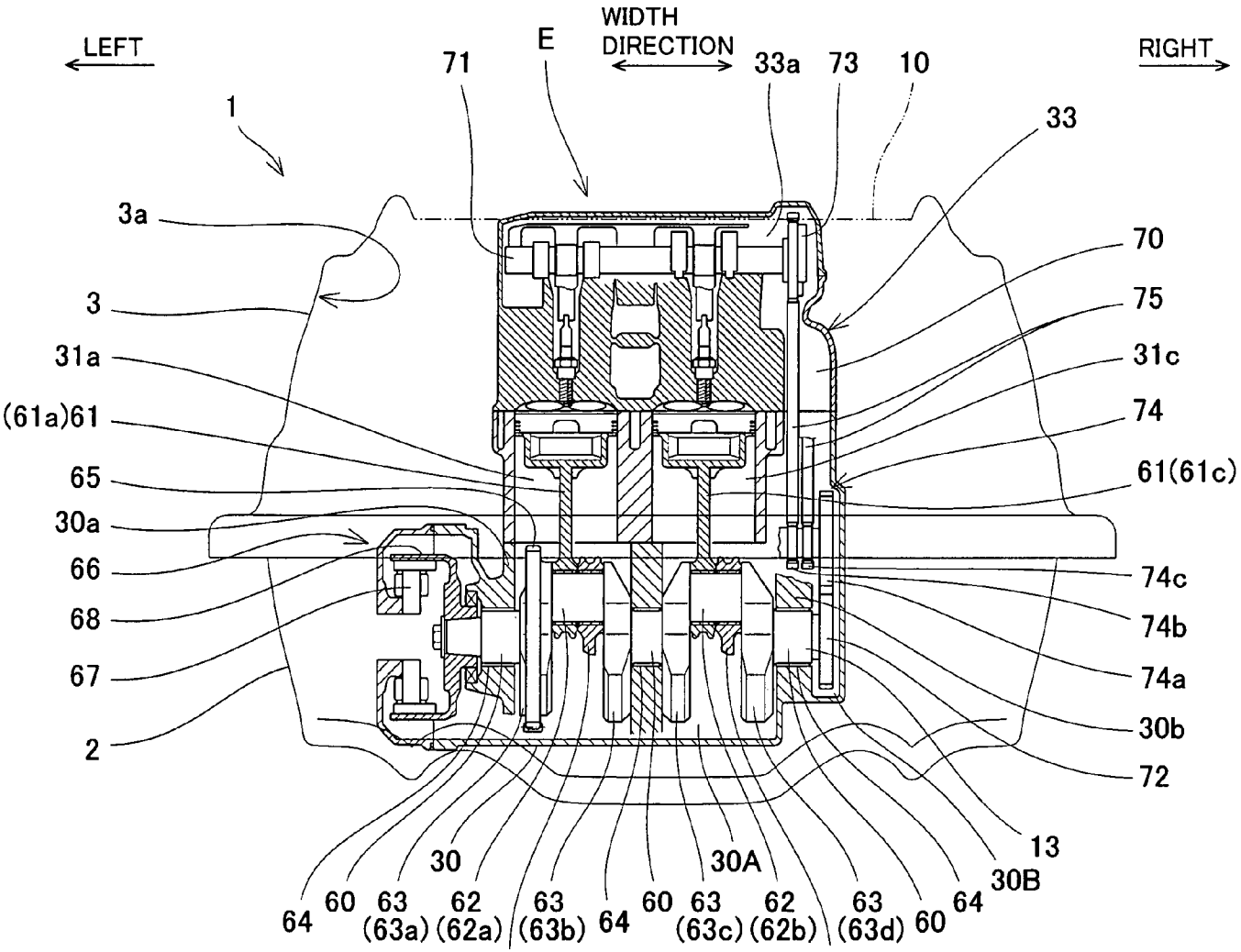
FIG. 3 is a rear cross-sectional view of the engine mounted in the personal watercraft in FIG. 1.

The engine E is constructed such that a crankshaft 13 extends in the width direction of the body 1, i.e., in the lateral direction of the body 1 (see FIG. 3). The engine E has an output shaft 14 in a rear portion thereof, extending in the longitudinal direction of the body 1, which is perpendicular to the crankshaft 13. Rotation is transmitted from the crankshaft 13 to the output shaft 14 by means of a rotation transmission system 82 to be described later (see FIG. 6). In this embodiment, the V-type engine E is a four-cylinder four-cycle engine.

A rear end of the output shaft 14 is connected to the propeller shaft 16 through a coupling means 15. The propeller shaft 16 is connected to the pump shaft 17 of the water jet pump P provided on the rear portion of the body 1. In this structure, the pump shaft 17 rotates cooperatively with rotation of the crankshaft 13.

An impeller 18 is attached on the pump shaft 17 of the water jet pump P. Fairing vanes 19 are provided behind the impeller 18. A tubular pump casing 20 is provided on the outer periphery of the impeller 18 and contains the impeller 18.

A water intake 21 is provided on the bottom of the body 1. The water intake 21 is connected to the pump casing 20 through a water passage. The pump casing 20 is connected to a pump nozzle 22 provided on the rear side of the body 1. The pump nozzle 22 has a cross-sectional area that gradually reduces rearward, and an outlet port 23 is provided on the rear end of the pump nozzle 22.

Water outside the watercraft is sucked from the water intake 21 and fed to the water jet pump P. The water jet pump P pressurizes and accelerates the water, and the fairing vanes 19 guide water flow behind the impeller 18. The water is ejected through the pump nozzle 22 and from the outlet port 23 and, as the resulting reaction, the watercraft obtains a propulsion force.

A tubular steering nozzle 24 is provided behind the pump nozzle 22. The steering nozzle 24 is connected to a steering handle 9 through a cable (not shown).

When the operator rotates the handle 9 clockwise or counterclockwise, the steering nozzle 23 is swung toward the opposite direction so that the ejection direction of the water being ejected through the pump nozzle 21 can be changed, and the watercraft can be correspondingly turned to any desired direction while the water jet pump P is generating the propulsion force.

Figure 2:
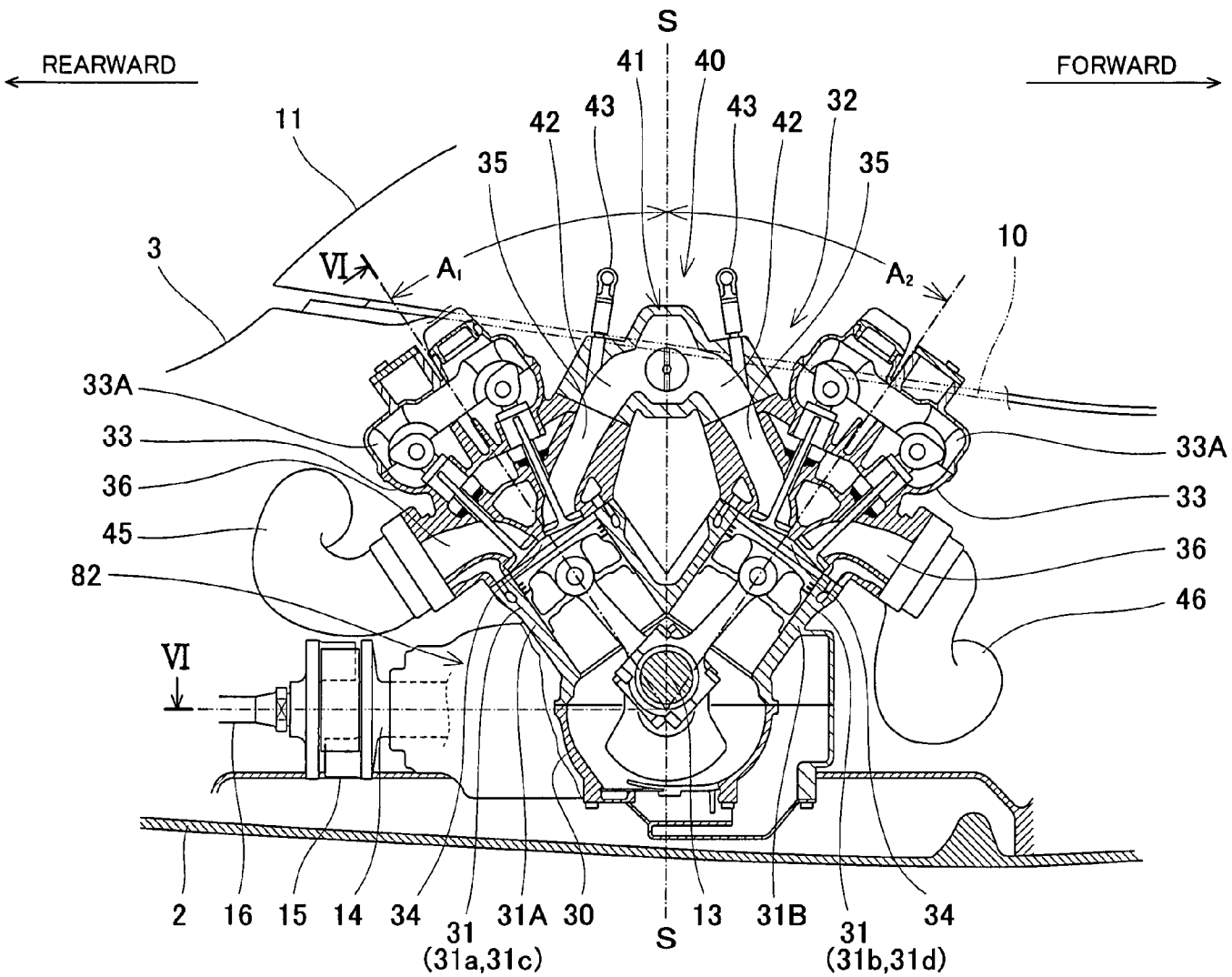
FIG. 2 is a side cross-sectional view of an engine mounted in the personal watercraft in FIG. 1.

As shown in FIGS. 2 and 3, the engine E is mounted such that the crankshaft 13 extends in the width direction of the body 1. Also, as shown in FIG. 2, the engine E is constructed such that a plurality of adjacent cylinders 31 are arranged in a V-shape in such a manner that the cylinders 31 are inclined to extend upward and forward and upward and rearward from a crankcase 30 of the engine E. A crank chamber is formed within the crankcase 30 of the engine E to accommodate the crankshaft 13 therein.

The cylinders 31 are arranged in the following order from the left of the engine E: a first cylinder 31*a*, a second cylinder 31*b*, a third cylinder 31*c*, and a fourth cylinder 31*d*. Herein, the first and third cylinders 31*a* and 31*c* are inclined such that they extend upward and rearward and form a rear-side cylinder 31A, and the second and fourth cylinders 31*b* and 31*d* are inclined such that they extend upward and forward and form a front-side cylinder 31B. And, a space formed between the cylinders 31 arranged in V-shape is called a bank space 32.

As shown in FIG. 2, an inclination angle A1 of the rear-side cylinder 31A with respect to a vertical plane S including the center axis of the crankshaft 13 is formed to be smaller than an inclination angle $A_2$ of the front-side cylinder 31B with respect to the vertical plane S. Such a structure provides a space behind the crankcase 30 and under the rear-side cylinder 31A to allow the rotation transmission system 82 of the engine E (see FIG. 6) to be placed therein.

As shown in FIG. 2, each cylinder head 33 is provided on a corresponding one of the cylinders 31. Within the cylinder head 33, an air-intake port 35 extends obliquely upward from a combustion chamber 34 of the engine E into the bank space 32, and an exhaust port 36 extends obliquely downward from the combustion chamber 34 toward an opposite side of the air-intake port 35.

Figure 4:
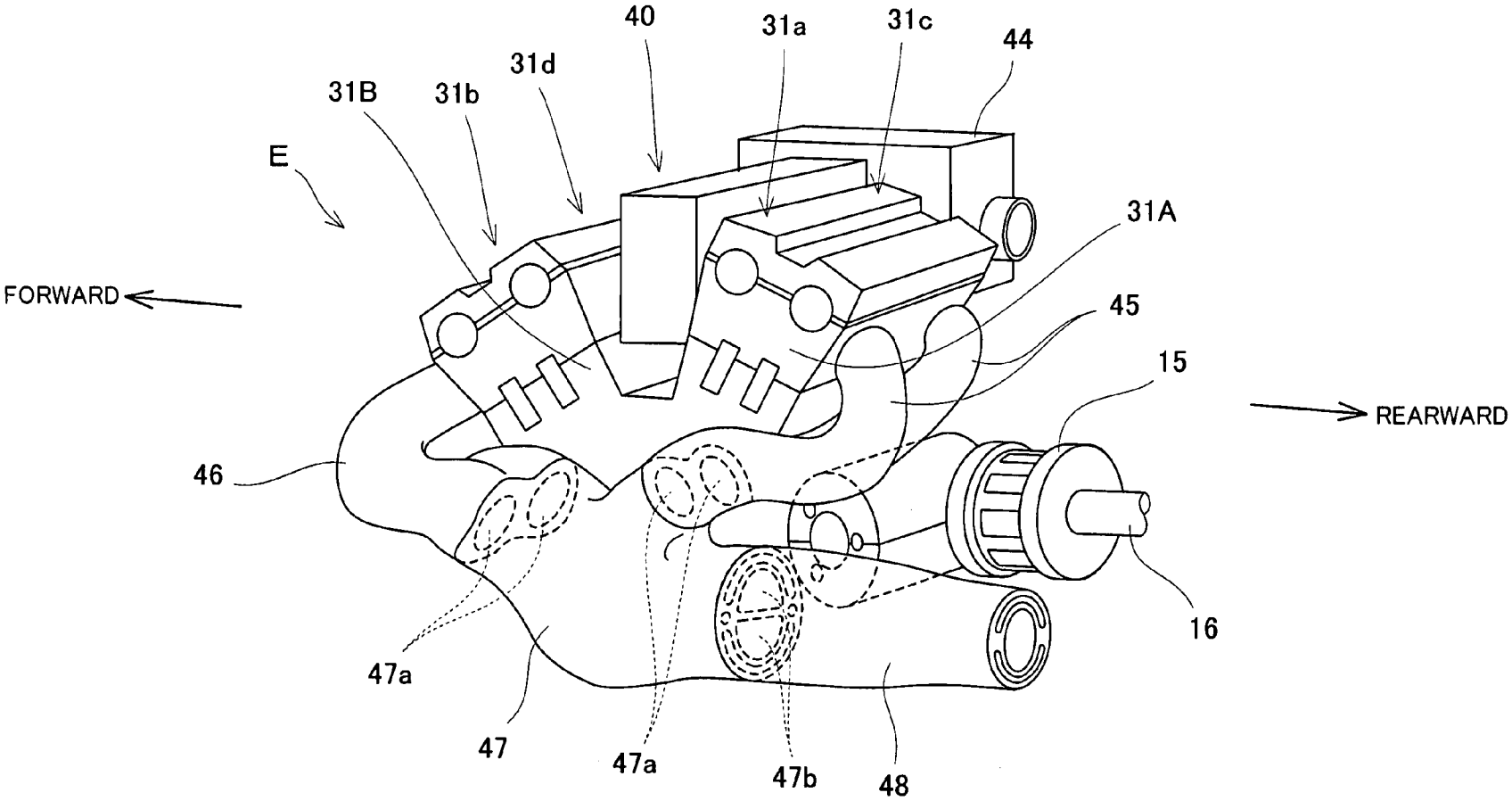
FIG. 4 is a perspective view of the engine mounted in the personal watercraft in FIG. 1.

As shown in FIGS. 2 and 4, an air-intake system passage 40 is provided within the bank space 32. As shown in FIG. 2, the air-intake system passage 40 comprises an air-intake chamber 41 and air-intake pipes 42 which are integrally molded. The air-intake chamber 41 is configured to temporarily store air to be sent to the combustion chambers 34, and the air-intake pipe 42 is configured to guide air from the air-intake chamber 41 to a corresponding one of the air-intake ports 35. An end portion of the air-intake pipe 42 is connected to an end portion of the air-intake port 35 on the bank space 32 side. It should be appreciated that the air-intake system passage 40 may be formed in such a manner that the air-intake chamber 41 and the air-intake pipes 42 are respectively molded and thereafter connected to each other.

As shown in FIG. 2, the air-intake pipes 42 are each provided with a fuel injector 43 configured to inject fuel. The fuel injector 43 is disposed so that fuel is injected substantially downward in a vertical direction. As shown in FIG. 4, an air cleaner box 44 is provided on a right side of the engine E to take in air from outside the watercraft. The air cleaner box 44 is connected to the air-intake chamber 41 through a pipe (not shown).

As shown in FIGS. 2 and 4, rear exhaust pipes 45 are respectively connected to the exhaust ports 36 of the cylinder head 33 on the rear-side cylinder 31A, and front exhaust pipes 46 are respectively connected to exhaust ports 36 of the cylinder head 33 on the front-side cylinder 31B.

The exhaust pipes 45 and 46 extend from the cylinder head 33 to the left-side of the engine E, and end portions thereof are connected to an exhaust manifold 47. The exhaust manifold 47 is located on the left side of the engine E and on an opposite side of the air cleaner box 44 relative to the engine E.

As shown in FIG. 4, the exhaust manifold 47 has four inflow ports 47*a* and two outflow ports 47*b*, and is configured to collect exhaust gases from the first and third cylinders 31*a* and 31*c* and exhaust gases from the second and fourth cylinders 31*b* and 31*d*, and to discharge the resulting exhaust gas to a collecting pipe 48 disposed behind the exhaust manifold 47. The collecting pipe 48 is configured to further collect the exhaust gases and to discharge the resulting exhaust gas outside the watercraft through a muffler or the like (not shown). In this embodiment, the front and rear exhaust pipes 45 and 46, the exhaust manifold 47, and the collecting pipe 48 form an exhaust system passage. The exhaust system passage is not intended to be limited to this structure, so long as the exhaust system passage is configured to collect exhaust gases from the exhaust ports of the cylinders and to discharge the collected exhaust gas rearward.

Figure 5:
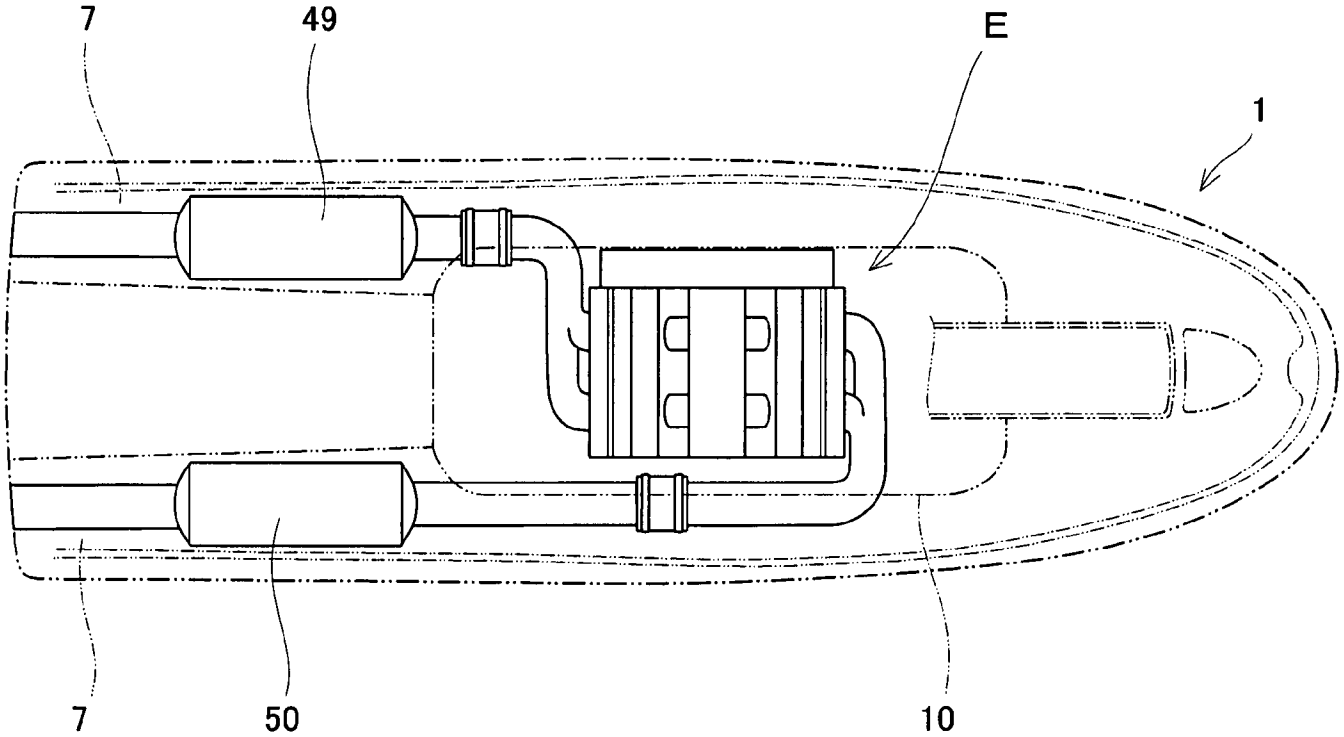
FIG. 5 is a plan view of the personal watercraft in FIG. 1.

As described above, an exhaust system of the engine E shown in FIG. 4 is configured to collect the exhaust gases from the four cylinders and to discharge the collected exhaust gas. Alternatively, as shown in FIG. 5, the exhaust system may be configured to discharge, outside the watercraft, through separate passages, the exhaust gas from the front-side cylinder 31B and the rear-side cylinder 31A.

In this case, mufflers 49 and 50 may be provided within the right and left deck fins 7 provided on the rear portion of the body 1. For example, the exhaust gas from the cylinders located forward is discharged outside the watercraft through the right-side muffler 50 and the exhaust gas from the cylinders located rearward is discharged outside the watercraft through the left-side muffler 49. By placing the mufflers 49 and 50 within the deck fins 7, a limited space within the body 1 of the watercraft is efficiently used, and buoyant forces in right and left parts of the body 1 are well balanced.

Figure 6:
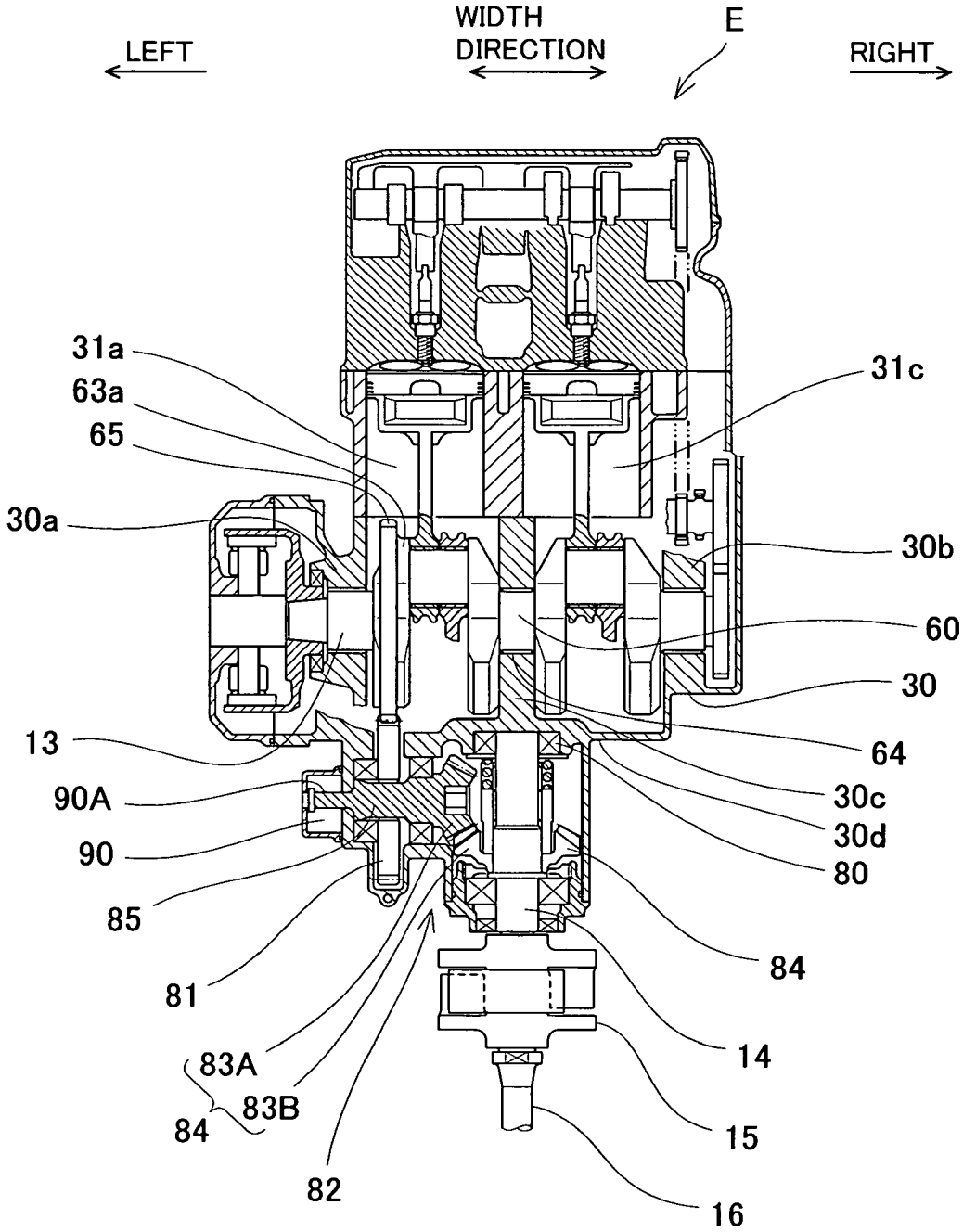
FIG. 6 is a cross-sectional view of the engine mounted in the personal watercraft in FIG. 2, taken along line VI—VI in FIG. 2.

As shown in FIGS. 3 and 6, the crankshaft 13 is comprised of crank journals 60 as a main shaft, crank pins 62 (62*a*, 62*b*) configured to rotatably support big ends of connecting rods 61 (61*a* to 61*d*), and crank webs 63 (63*a* to 63*d*) connecting the crank journals 60 to the crank pins 62.

The crank journals 60 are provided at three positions, i.e., a left portion, a right portion, and a center portion of the crankshaft 13. The crankcase 30 has a left side wall 30*a* and a right side wall 30*b* forming a crank chamber 30A as an inner space, and a center wall 30*c* provided at the center portion to define right and left parts of the crank chamber 30A. And, the left, right, and center crank journals 60 are rotatably supported by means of bearings 64 supported by the left side wall 30*a*, the right side wall 30*b*, and the center wall 30*c*, respectively. Since the left side wall 30*a*, the right side wall 30*b*, and the center wall 30*c* configured to support the bearings 64 in the crankcase 30 must support the crank journals 60 that rotate at a high speed to generate a high torque, they are designed to have high rigidity.

The left-side crank pin 62*a* supports the connecting rods 61*a* and 61*b* respectively corresponding to the first and second cylinders 31*a* and 31*b*, and the right-side crank pin 62*b* supports the connecting rods 61*c* and 61*d* respectively corresponding to the third and fourth cylinders 31*c* and 31*d*.

The crank webs 63*a* to 63*d* respectively connecting the crank journals 60 to the crank pins 62 are each structured such that a crank arm and a crank weight (balance weight) are integral with each other. The leftmost crank web 63*a* is provided with a spur gear on an outer periphery, and forms a drive gear 65 adapted to output rotation of the crankshaft 13.

As shown in FIG. 3, a generator 66 is provided on a left end portion of the crankshaft 13. The generator 66 has a stator 67 supported by the crankcase 30 and a rotor 68 adapted to rotate integrally with the crankshaft 13.

A chain tunnel 70 is formed on a right-side portion of the engine E, and configured to connect a cam chamber 33A formed in an upper portion of the cylinder head 33 and a gear case 30B formed externally on the right side wall 30*b* of the crank chamber 30A. Camshaft drive gears 72 are mounted on a right-end portion of the crankshaft 13 which protrudes from the right side wall 30*b* of the crankcase 30A into the gear case 30B. The camshaft drive gear 72 serves to drive a camshaft 71 provided in the cylinder head 33. The camshaft 71 is provided within the cam case 33A at an upper portion of the cylinder head 33 so as to extend in parallel with the crankshaft 13.

The camshaft drive gear 72 is a spur gear mounted concentrically on the crankshaft 13. The drive gear 72 serves to transmit rotation of the crankshaft 13 to a camshaft driven gear 73 mounted concentrically on the camshaft 71 through a relay gear 74.

The relay gear 74 is comprised of a first relay gear 74*a* formed by a spur gear, and second relay gears 74*b* and 74*c* formed by sprockets. The first relay gear 74*a* and the second relay gears 74*b* and 74*c* are concentrically provided such that their center axes extend in parallel with the crankshaft 13 and the camshaft 71.

The first relay gear 74*a* is located above the camshaft drive gear 72 and is in mesh with the camshaft drive gear 72. The second relay gears 74*b* and 74*c* are arranged concentrically with the first relay gear 74*a* and closer to the center of the engine E than the first relay gear 74*a*, and is configured to rotate together with the first relay gear 74*a*. The camshaft driven gears 73 for the front-side cylinder 31B and the rear-side cylinder 31A are respectively disposed above the second relay gears 74*b* and 74*c*. The second relay gears 74*b* and 74*c* are connected to the corresponding camshaft driven gears 73 through chains 75.

In this structure, the camshaft drive gear 72 is connected to the camshaft driven gear 73 through the relay gear 74 offset toward the center of the engine E. The chain tunnel 70 is shaped such that its upper portion is offset toward the center of the engine E relative to the gear case 30B. Such a structure makes the camshaft 71 shorter, in contrast to a structure in which the camshaft drive gear 72 is connected to the camshaft driven gear 73 through a chain. The camshaft drive gears 72, the relay gears 74, and the camshaft driven gears 73 may be pulleys, and the chains 75 may be belts.

As shown in FIG. 6, the output shaft 14 provided with a coupling means 15 at a rear end portion thereof is disposed on a rear portion of the engine E. The output shaft 14 extends in the direction substantially perpendicular to the crankshaft 13 and in the longitudinal direction of the watercraft substantially at a center position in the width direction of the body 1 of the watercraft. A base end portion of output shaft 14 is rotatably supported by means of a bearing 80 mounted on the rear wall 30*d* located behind the center wall 30*c* of the crank chamber 30A. Therefore, the output shaft 14 is rigidly supported by the center wall 30*c* and the rear wall 30*d* that are highly rigid.

As shown in FIGS. 2 and 6, the rotation transmission system 82 of the engine E is provided on the rear portion of the crankcase 30 and under the rear-side cylinder 31B and configured to transmit rotation of the crankshaft 13 to the output shaft 14 in such a manner that a rotation axis of rotation of the crankshaft 13 is different from a rotation axis of rotation of the output shaft 14. The rotation transmission system 82 comprises the drive gear 65 formed on the outer peripheral portion of the crank web 63*a*, an intermediate gear 81, an output-side bevel gear 83A, and an input-side bevel gear (driven gear) 84.

The intermediate gear 81 is mounted concentrically on the intermediate shaft 85 extending in parallel with the crankshaft 13 and is in mesh with the drive gear 65 of the crankshaft 13. The output-side bevel gear 83A is fixed to an end portion of the intermediate shaft 85 on the center side of the engine E such that the bevel gear 83A is concentric with the intermediate shaft 85. The input-side bevel gear 83B is mounted concentrically on the output shaft 14. The output-side bevel gear 83A and the input-side bevel gear 83B are in mesh with each other and configured such that their rotation axes are different from each other. The output-side and input-side bevel gears 83A and 83B form a rotation axis change system.

When the crankshaft 13 rotates, the drive gear 65 correspondingly rotates, thereby causing the intermediate gear 81 to rotate. Thereby, the output-side bevel gear 83A rotates, thereby causing the input-side bevel gear 83B to rotate. As a result, the output shaft 14 rotates. In the manner as described above, the rotation of the output shaft 14 is transmitted from the crankshaft 13 in such a manner its rotation axis is substantially perpendicular to a rotation axis of rotation of the crankshaft 13.

As shown in FIG. 6, an oil pump 90 is provided on an end portion of the intermediate shaft 85 on an outer side of the engine E. The oil pump 90 has a pump shaft 90A formed by the end portion of the intermediate shaft 85, and is driven by rotation of the intermediate shaft 85. Alternatively, an end portion on a base end side of the output shaft 14 may be extended forward relatively to the engine E, and the oil pump may be provided at the end portion. In this structure, a front end portion of the output shaft 14 forms the pump shaft, and the oil pump is driven by rotation of the output shaft 14.

In this embodiment, the engine E is constructed such that gears of the drive gear 65 and gears of the intermediate gear 81 are different in number. Such a structure make it possible to increase or decrease a rotation speed of the output shaft 14 and the oil pump 90 which is to be transmitted from the crankshaft 13.

If gears of the output-side bevel gear 83A and gears of the input-side bevel gear 83B are made different in number, then a speed of rotation transmitted from the intermediate shaft 85 to the output shaft 14 can be increased or decreased. Further, by adjusting the number of gears of the drive gear 65 and the intermediate gear 81, and the number of gears of the output-side bevel gear 83A and the input-side bevel gear 83B, it is possible to gain a rotation speed of the intermediate shaft 85 compatible with a characteristic of the oil pump P, and a rotation speed of the output shaft 14 compatible with a characteristic of the water jet pump P.

In this embodiment, the rotation transmission system 82 comprises the drive gear 65, the intermediate gear 81, the output-side bevel gear 83A, and the input-side bevel gear 83B, but the structure of the rotation transmission system is not intended to be limited to this. For example, the drive gear mounted on the crankshaft 13 and the driven gear mounted on the output shaft 14 may be formed by a pair of bevel gears which meshes with each other. Such a structure may make the rotation transmission system small-sized.

In the watercraft constructed as described above, the four-cycle V-type engine with the center of gravity located low can be mounted as an engine for driving the water jet pump P. As shown in FIGS. 3 and 5, the V-type four-cycle engine mounted in the engine room 12 in such a manner that the crankshaft extends in the width direction of the watercraft, can be substantially contained within the deck opening 10. In particular, the cylinder head and the cylinder head cover located above the front-side and rear-side cylinders 31B and 31A can be disposed within the deck opening 10. Therefore, components located within or in the vicinity of the cylinder head 33 of the engine E can be maintained through the deck opening 10.

Further, the V-type four-cycle engine E having the crankshaft 13 extending in the width direction of the watercraft has a relatively small dimension in the width direction. Thereby, as shown in FIG. 3, since clearance between the engine E and an inner wall 3*a* of the body 1 can be made larger, the auxiliary devices arranged in the vicinity of the bottom of the body 1 are accessible through the deck opening 10. As a result, the auxiliary devices are easily maintained.

As this invention may be embodied in several forms without departing from the spirit of essential characteristics thereof, the above embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A water-jet propulsion personal watercraft, comprising:

a body including a hull and a deck covering the hull from above;

a water jet pump configured to propel the watercraft and including a pump shaft extending in a longitudinal direction of the body;

a V-type four-cycle engine mounted within the body and configured to drive the water jet pump, the engine having a front-side cylinder inclined to extend upward and forward and a rear-side cylinder inclined to extend upward and rearward, wherein the engine includes:

a crankshaft;

an output shaft extending in a direction substantially perpendicular to the crankshaft and connected to the pump shaft, the output shaft being configured to output rotation transmitted from the crankshaft to outside the engine; and a rotation transmission system configured to transmit the rotation of the crankshaft to the output shaft, wherein the engine is mounted within the body in such a manner that the crankshaft extends in a width direction of the body, and the output shaft is provided to extend rearward through a rear wall of a crankcase such that its axial direction corresponds with the longitudinal direction of the body, and is rotatably supported by a rear wall of a crank chamber formed within the crankcase of the engine.

2. The water-jet propulsion personal watercraft according to claim 1, wherein the rotation transmission system has a drive gear mounted concentrically on the crankshaft and configured to rotate integrally with the crankshaft, and a rotation axis change system configured to transmit the rotation of the crankshaft to the output shaft in such a manner that a rotation axis of rotation of the drive gear is different from a rotation axis of rotation of the output shaft.

3. The water-jet propulsion personal watercraft according to claim 2, wherein the rotation transmission system has an intermediate shaft provided in parallel with the crankshaft, an intermediate gear mounted concentrically on the intermediate shaft and configured to rotate integrally with the intermediate shaft in mesh with the drive gear, an output-side bevel gear mounted concentrically on the intermediate shaft and configured to rotate integrally with the intermediate shaft, and an input-side bevel gear mounted on the output shaft and configured to mesh with the output-side bevel gear.

4. The water-jet propulsion personal watercraft according to claim 3, wherein the drive gear is formed on an outer peripheral portion of a crank web of the crankshaft.

5. The water-jet propulsion personal watercraft according to claim 3, wherein the engine includes an oil pump having a pump shaft connected integrally with the intermediate shaft.

6. The water-jet propulsion personal watercraft according to claim 2, wherein the rotation transmission system is configured to transmit the rotation of the crankshaft to the output shaft in such a manner that a rotation speed of the output shaft is different from a rotation speed of the crankshaft.

7. The water-jet propulsion personal watercraft according to claim 1, wherein the crankshaft is supported by bearings mounted on right and left side walls of the crank chamber of the crankcase, and a bearing mounted on a center wall provided within the crank chamber, and the output shaft is supported in the vicinity of a connecting portion between the center wall and the rear wall.

8. The water-jet propulsion personal watercraft according to claim 1, wherein the rear-side cylinder of the engine is placed such that an inclination angle of the rear-side cylinder with respect to a vertical plane including a center axis of the crankshaft is smaller than an inclination angle of the front-side cylinder with respect to the vertical plane, and the rotation transmission system is disposed behind the crankshaft and under the rear-side cylinder.

9. The water-jet propulsion personal watercraft according to claim 1, wherein the engine has a camshaft drive gear mounted on one end portion of the crankshaft to drive a camshaft driven gear mounted on one end of a camshaft located above each of the cylinders and a generator mounted on an opposite end portion of the crankshaft.

10. The water-jet propulsion personal watercraft according to claim 9, wherein the engine further includes a relay gear which is provided between the camshaft drive gear of the crankshaft and the camshaft driven gear of the camshaft and which is configured to allow rotation of the camshaft drive gear to be transmitted to the camshaft driven gear therethrough, and the relay gear has a first relay gear, and a second relay gear located closer to a center of the engine than the first relay gear in a longitudinal direction of the crankshaft and configured to rotate integrally with the first relay gear, wherein the first relay gear meshes with the camshaft drive gear and the second relay gear is connected to the camshaft driven gear through a chain or a belt.

11. The water-jet propulsion personal watercraft according to claim 1, further comprising: an exhaust system passage including exhaust pipes respectively extending from front-side and rear-side cylinder heads, and a collecting portion into which the exhaust pipes gather; and an air cleaner box provided in an air-intake system of the engine, wherein the collecting portion of the exhaust system passage is provided on one axial end portion side of the crankshaft and the air cleaner box is provided on an opposite axial end portion side of the crankshaft.

12. The water-jet propulsion personal watercraft according to claim 11, wherein the engine has an air-intake chamber provided in a bank space between the front-side cylinder and the rear-side cylinder such that the air-intake chamber is located downstream of the air cleaner box in flow of taken-in air and connected to air-intake ports of the engine through air-intake pipes.

13. The water-jet propulsion personal watercraft according to claim 12, wherein the air-intake pipes are respectively provided with injectors extending substantially vertically downward.

14. The water-jet propulsion personal watercraft according to claim 1, wherein the body has a deck opening elongate in the longitudinal direction of the body on an upper portion of the body, and a portion located above each of the cylinders of the engine is located within the deck opening as seen in a plan view.

15. A water-jet propulsion personal watercraft, comprising:

a body including a hull and a deck covering the hull from above;

a water jet pump configured to propel the watercraft and including a pump shaft extending in a longitudinal direction of the body;

a V-type four-cycle engine mounted within the body and configured to drive the water jet pump, the engine having a front-side cylinder inclined to extend upward and forward and a rear-side cylinder inclined to extend upward and rearward, wherein the engine includes:

a crankshaft;

an output shaft extending in a direction substantially perpendicular to the crankshaft and connected to the pump shaft, the output shaft being configured to output rotation transmitted from the crankshaft to outside the engine; and a rotation transmission system configured to transmit the rotation of the crankshaft to the output shaft, wherein the engine is mounted within the body in such a manner that the crankshaft extends in a width direction of the body, and the rear-side cylinder of the engine is placed such that an inclination angle of the rear-side cylinder with respect to a vertical plane including a center axis of the crankshaft is smaller than an inclination angle of the front-side cylinder with respect to the vertical plane, and the rotation transmission system is disposed behind the crankshaft and under the rear-side cylinder.

16. A water-jet propulsion personal watercraft, comprising:

a body including a hull and a deck covering the hull from above;

a water jet pump configured to propel the watercraft and including a pump shaft extending in a longitudinal direction of the body;

a V-type four-cycle engine mounted within the body and configured to drive the water jet pump, the engine having a front-side cylinder inclined to extend upward and forward and a rear-side cylinder inclined to extend upward and rearward, wherein the engine includes:

a crankshaft;

an output shaft extending in a direction substantially perpendicular to the crankshaft and connected to the pump shaft, the output shaft being configured to output rotation transmitted from the crankshaft to outside the engine; and a rotation transmission system configured to transmit the rotation of the crankshaft to the output shaft, wherein the engine is mounted within the body in such a manner that the crankshaft extends in a width direction of the body, and the body has a deck opening elongate in the longitudinal direction of the body on an upper portion of the body, and a portion located above each of the cylinders of the engine is located within the deck opening as seen in a plan view.

* * * * *